US008899945B2

(12) United States Patent
Laboube

(10) Patent No.: US 8,899,945 B2
(45) Date of Patent: Dec. 2, 2014

(54) CENTRIFUGAL COMPRESSOR UNIT

(75) Inventor: Pierre Laboube, Lyons (FR)

(73) Assignee: Thermodyn, Le Creusot (FR)

( * ) Notice: Subject to any disclaimer, the term of this patent is extended or adjusted under 35 U.S.C. 154(b) by 110 days.

(21) Appl. No.: 13/280,266

(22) Filed: Oct. 24, 2011

(65) Prior Publication Data

US 2012/0100017 A1 Apr. 26, 2012

(30) Foreign Application Priority Data

Oct. 25, 2010 (FR) ..... 10 58730

(51) Int. Cl.

| | |
|---|---|
| ***F04D 25/06*** | (2006.01) |
| ***F04D 29/054*** | (2006.01) |
| ***F04D 29/58*** | (2006.01) |
| ***F04D 25/02*** | (2006.01) |
| ***F04D 17/12*** | (2006.01) |

(52) U.S. Cl.

CPC ..... *F04D 17/122* (2013.01); *F04D 29/054* (2013.01); *F04D 29/584* (2013.01); *F04D 25/022* (2013.01)

USPC ..... 417/423.12; 417/423.14; 417/366

(58) Field of Classification Search

USPC ..... 417/365, 366, 423.12, 423.14, 423.5

See application file for complete search history.

(56) References Cited

U.S. PATENT DOCUMENTS

| | | | | |
|---|---|---|---|---|
| 1,071,042 | A | 8/1913 | Fuller | |
| 2,073,404 | A * | 3/1937 | Hobbs | 417/351 |
| 2004/0179961 | A1 * | 9/2004 | Pugnet et al. | 417/423.5 |
| 2007/0110601 | A1 * | 5/2007 | Lenderink et al. | 417/423.12 |

FOREIGN PATENT DOCUMENTS

WO 2004083644 9/2004

OTHER PUBLICATIONS

EPO Form 1503, FR, Jun. 3, 2011, French Search Report for FR 1058730.

* cited by examiner

*Primary Examiner* — Bryan Lettman
(74) *Attorney, Agent, or Firm* — Edwards Wildman Palmer LLP; Steven M. Jensen

(57) ABSTRACT

One aspect of the invention provides a centrifugal compressor unit (1) comprising a first motor (3), at least one compressor (2) comprising a drive shaft (9) driven by the rotor (12) of the first motor (3) and a set of impellers (5, 6, 7, 8) mounted on the drive shaft (9). The first motor (3) and the compressor (2) are mounted in a gas-tight common housing (26) operated by the compressor unit (1). The rotor (12) of the first motor (3) and the drive shaft (9) are connected by a flexible coupling (24) placed in the housing (26). The compressor unit includes a second motor (4) that is placed in the housing and of which the rotor (13) is connected to the drive shaft (9) by a second flexible coupling (25).

12 Claims, 2 Drawing Sheets

CENTRIFUGAL COMPRESSOR UNIT

RELATED APPLICATION

This application claims priority to French application Ser. No. FR 10 58730, filed Oct. 25, 2010, the entire disclosure of which is incorporated herein by this reference.

The invention relates to turbocompressors or motorcompressors and in particular to integrated motorcompressor units.

An integrated motorcompressor unit comprises a sealed housing in which an electric motor and a compressor unit, for example with several stages, are placed which comprises several compression impellers supported by a driven shaft coupled to a rotor driven by the motor.

It was first of all proposed to couple the driven shaft and the rotor by means of a rigid coupling, bearings being provided to support the ends of the shaft line of the motorcompressor unit and its middle portion.

Although advantageous in terms of simplification of the shaft line, insofar as the assembly consisting of the motor, the coupling and the compressor is located inside a single housing and is subjected to the intake gas pressure of the first compression stage, such a structure requires a perfect alignment of the rotor and the driven shaft on assembly.

It has therefore been proposed to couple the rotor and the driven shaft by means of a flexible coupling in order to avoid the alignment problems. Moreover, this solution allows the rotor and the driven shaft to preserve their specific vibratory behaviours insofar as they remain mechanically decoupled.

Reference in this respect can be made to document WO2004/083644 which describes such an arrangement.

It has however been found that, although the motor usually consists of a high-speed motor, that is to say with a rotational frequency higher than the frequency of the electrical power supply network, this type of motorcompressor unit remains limited in terms of power.

Since the power delivered by the motorcompressor unit is linked to the rotation speed of the compressor, it is not usually possible, with this type of known motorcompressor unit, to obtain very high power values for rotation-speed values imposed by the motor.

Although certain motorcompressor units are capable of supplying powers of the order of 12.5 MW for rotation speeds of the order of 10 500 rpm or of the order of 8 MW for rotation speeds of the order of 13 500 rpm, power requirements of approximately 15 MW cannot be satisfied by current motorcompressor units that have, for example, a motor having a speed of the order of 13 500 rpm.

In particular, the necessary increase in power for a given rotation speed currently requires increasing the size of the vanes of the compressor which results in an unacceptable increase in the stresses that are applied to the shaft line.

Moreover, since environmental standards and European directives are increasingly strict, the motorcompressor units operating in an "explosive atmosphere" are subjected to very strict regulation, constraining the design of such motorcompressors.

"Explosive atmosphere" means an atmosphere which could become explosive due to local conditions (presence of air, of fuel, and of a hot source or of a spark). It involves a mixture of air and of flammable substances in the form of gas, vapour or dust, in which, after ignition, combustion is propagated throughout the mixture of unburned gases.

In view of the foregoing, the object of the invention is to overcome the drawbacks of integrated motorcompressor units with rigid coupling and to propose a motorcompressor unit delivering higher power at one and the same rotation speed.

The subject of the invention is a centrifugal compressor unit comprising a first motor, at least one compressor comprising a driven shaft driven by the rotor of the first motor and a set of impellers mounted on the driven shaft, the assembly consisting of the motor and the compressor being mounted in a gas-tight common housing operated by the compressor unit, the rotor of the first motor and the driven shaft being connected by a flexible coupling placed in the housing.

The motorcompressor unit comprises a second motor which is placed in the housing and of which the rotor is connected to the driven shaft by a second flexible coupling.

Thus, the available power is greater for one and the same rotation speed, and the rotation speed is higher for one and the same available power. The flexible coupling between each of the electric motors and the compressor makes it possible to retain the dynamic characteristics of the associated rotors and to limit the stresses applied to the shaft line, in particular for high powers.

Advantageously, the compressor unit comprises a means for cooling the motors. By virtue of this integrated cooling system, an internal circulation of the gases is created without the need to install a ventilation system, and while thus limiting the leakages of gas to the outside atmosphere.

It is also possible, as a variant, to provide an external cooling-gas circuit associated, as necessary, with an additional external cooling system.

For example, the cooling means comprises at least one cooling circuit comprising gas circulation ducts connecting the motors and the compressor.

The housing may comprise several housing elements secured together in a sealed manner, each housing element enclosing a motor or the compressor, in order to simplify the operations of machining and of installing the motorcompressor.

Advantageously, the housing is provided with orifices made between each of the adjacent housing elements for access to the flexible coupling, each orifice being furnished with sealed obstruction means.

Each end of the driven shaft or of the rotors may be supported by an end bearing secured to the housing.

For example, the end bearings are radial magnetic bearings.

Moreover, the motorcompressor unit comprises an axial abutment on which the driven shaft of the compressor rests when the motorcompressor is operating.

For example, the axial abutment is a magnetic abutment.

The motorcompressor unit may comprise an axial thrust-balancing piston on which the driven shaft of the compressor rests when the motorcompressor is operating.

Other objects, features and advantages of the invention will appear on reading the following description given only as a non-limiting example and made with reference to the appended drawings in which.

Figure 1:
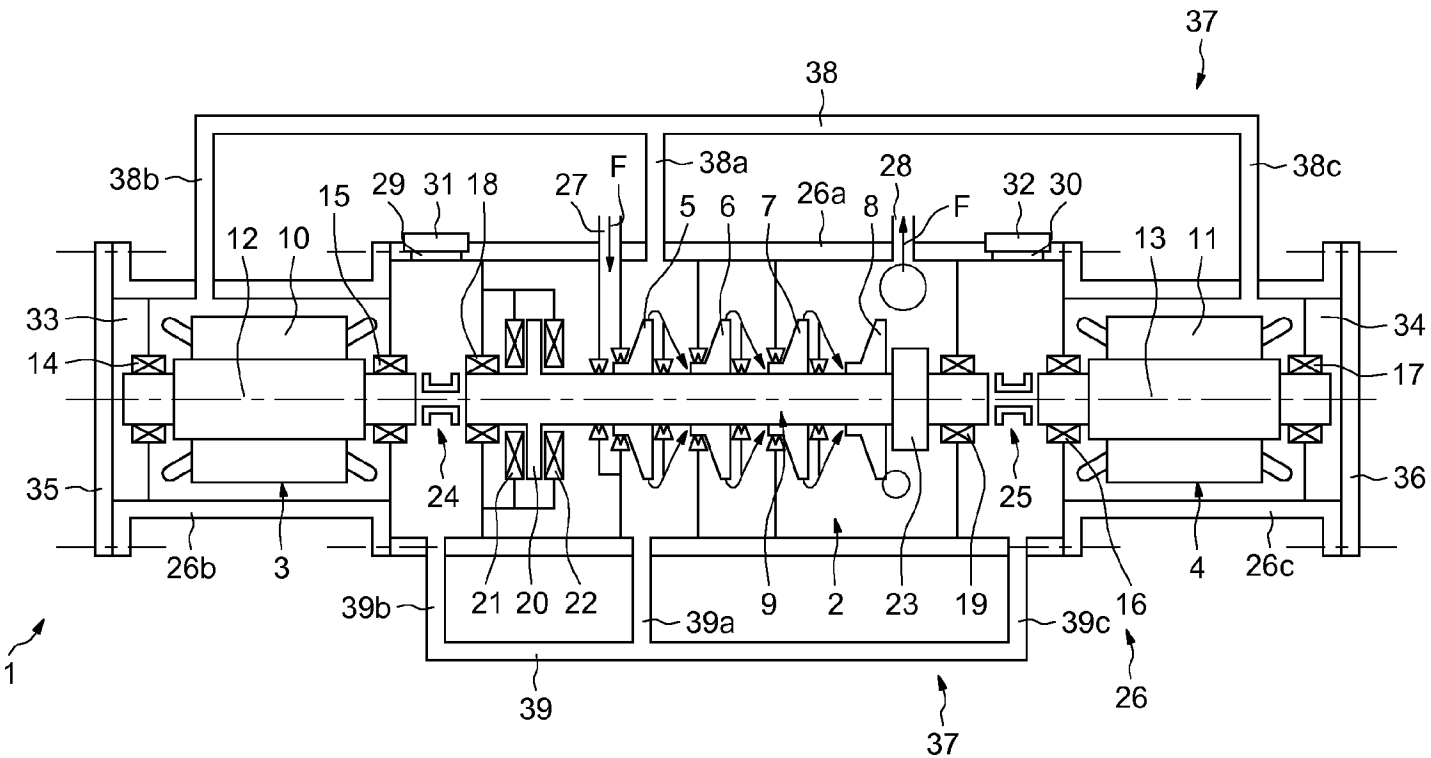
FIG. 1 illustrates a schematic diagram of a motorcompressor unit according to the invention.

As illustrated in FIG. 1, the motorcompressor unit designated by the general reference 1, comprises essentially a compressor unit 2 rotated by two electric motors 3, 4 at a high speed of rotation, for example of the order of 14 000 rpm for a unit motor power of 8 MW, that is to say of which the rotation frequency is higher than the frequency of the electric power network. The motors are if necessary supplied by a frequency variator (not shown) itself powered by the network.

Figure 2:
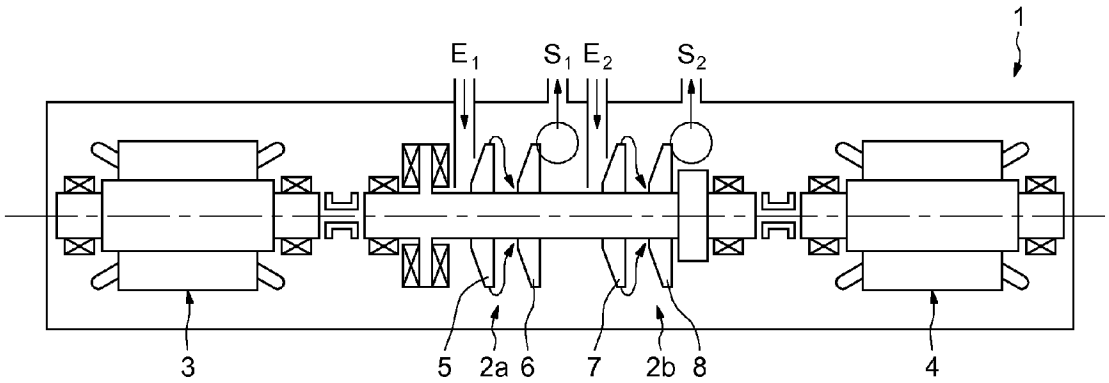
FIG. 2 represents another embodiment of a motorcompressor unit according to the invention.
Figure 3:
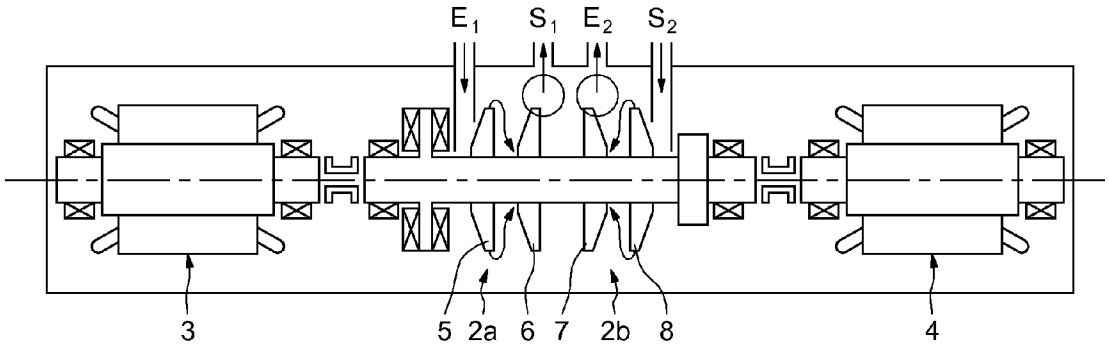
FIG. 3 represents a third embodiment of a motorcompressor unit according to the invention.

The compressor unit 2 comprises a set of impellers 5, 6, 7 and 8, in this instance four in number, installed on a driven shaft 9. It will be noted that the compressor 2 may comprise any number of impellers, or as illustrated in FIGS. 2 and 3, the compressor may comprise another arrangement of impellers.

Each of the electric motors 3, 4 comprises a stator 10, 11 and a rotor 12, 13 rotating the driven shaft 9. As will be explained in detail below, the rotors 12, 13 and the driven shaft 9 are coupled by means of a flexible coupling 24, 25. The rotors 12, 13 are then supported respectively by two end radial bearings 14, 15 and 16, 17. Similarly, the driven shaft 9 of the compressor 2 pivots in two radial bearings 18, 19. Preferably, the bearings used do not require supplying with lubricating fluid. Accordingly, it is possible to use, for example, radial bearings of the active magnetic type.

In order to withstand the forces generated when the compressor 2 is operating, which forces tend to act upon the shaft line axially, an axial abutment 20, for example of the magnetic type, secured to the driven shaft 9, is placed between two fixed bearings 21, 22 so as to limit the axial movement of the driven shaft 9 of the compressor 2. An axial aerodynamic balancing piston 23 secured to the driven shaft 9 is placed at the opposite end of the axial abutment 20. It will be noted that the axial abutment 20 could be mounted in place of the balancing piston 23 and vice versa.

As can be seen in FIG. 1, the two ends of the driven shaft 9 are each coupled to a corresponding end of one of the rotors 12, 13.

The shaft 9 is therefore driven via its two ends by two distinct motors 3, 4 so that the transmitted power is considerably increased. It is thus possible, for example, to achieve powers of the order of 15 MW for rotation speeds of the order of 14 000 rpm or even 25 MW for the rotation speeds of approximately 10 000 rpm, or, for one and the same power level, increased rotation speeds.

As indicated above, each of the rotors 12, 13 of the motors 3, 4 is coupled to the driven shaft 9 of the compressor 2 via flexible couplings 24, 25. Such a coupling may be produced either from a coupling of the flexible strip type, or of the twistable shaft type. However, any other type of flexible coupling appropriate to the invention may be used. It will be noted that the use of a twistable shaft coupling makes it possible to reduce the losses by ventilation, the generated noise level and to propagate the thrust more easily. Thus, the thrust on each motor being very low, the electric motors do not require any other element, such as an axial abutment or a balancing piston, to provide their axial balancing.

Thus, each of the rotors 12, 13 and the compressor 2 retains the vibratory behaviour that is specific to it. It will be noted that the rotor of the motor is usually of the rigid type with the first critical flexing speed above the rotation speed. The rotor 9 of the compressor 2 is usually of the flexible type with the first critical flexing speed below the maximum rotation speed. This prevents creating specific flexing modes coupled between the rotors 12, 13, 9 risking developing, during operation, hot points on the rotor of the motor constituting thermal imbalances of phase and of amplitude that cannot be controlled. The presence of flexible couplings 24, 25 moreover makes it easier to position the first specific frequency of torsion and also helps to reduce the stress at the ends of the driven shaft 9 in the event of short circuit at the terminals of the electric motor or motors 3, 4.

The whole of the motorcompressor unit 1, and in particular the motors and the compressor unit 2, is mounted in an internal common gas-tight housing 26 operated by the motorcompressor 1. In the example illustrated, the common housing 26 consists of an assembly of secured housings 26*a*, 26*b*, 26*c* respectively providing the support and protection of the compressor 2 and of the motors 3, 4. The housings 26*a*, 26*b*, 26*c* are secured together by appropriate fastening means (not shown) allowing the housings to be fastened together rigidly and in a sealed manner. The separation of the common housing 26 into subhousings makes it easier to machine and assemble and disassemble the motorcompressor 1.

The housing 26*a* comprises a gas-inlet orifice 27 for taking the gases into the motorcompressor unit 1, which orifice emerges at the first compression stage consisting of the impeller 5, and an outlet orifice 28 collecting the gas handled by the turbocompressor at the outlet of the last compression stage consisting of the impeller 8. An arrow F indicates the direction of travel of the gas.

In order to gain access to the flexible couplings 24 and 25, the housing 26*a* is provided with orifices 29, 30 emerging respectively opposite the junction zone between the rotor 12 of the first electric motor 3 and the driven shaft 9 of the compressor 2 and at the junction zone between the rotor 13 of the second electric motor 4 and the driven shaft 9 of the compressor 2. These orifices 29, 30 are each associated with a removable sealed obstruction device 31, 32.

The opposite ends 33, 34 of the housing 26 are each obstruction by a cap 35, 36.

By virtue of this arrangement, the assembly of the motorcompressor unit is made much easier since the housing elements 26*a*, 26*b*, 26*c* which support the motor or the compression stage, can be easily assembled in a rigid and sealed manner, the orifices 29 and 30 make it possible to couple the rotors 12, 13 and the driven shaft 9 without it being necessary to carry out dynamic lining-up or dynamic balancing operations.

Similarly, the maintenance of the motorcompressor unit 1 is made easier. Specifically, it is easy to extract each of the electric motors 3, 4 and the rotors 12, 13 which are still supported by their bearings 18, 19.

It is indeed possible to decouple each of the couplings 24, 25 from the respective orifices 29, 30 passing through the housing 26*a* and to extract each of the rotors 12, 13 while the driven shaft 9 of the compressor 2 remains supported by its two bearings 18, 19. In this manner, the rotors 12, 13 and the driven shaft 9 are protected during the maintenance operation. The operations of reassembly, of lining up and of dynamic balancing are therefore made easier because of the access to the two central planes on each shaft end.

The whole interior of the motorcompressor 1 is bathed in the gas handled by the compressor 2, including the flexible couplings 24, 25. In particular, the internal volume of the motorcompressor 1 contains no shaft emergence sealing but only rotating seals subjected to slight pressure differences, such as for example, rotating seals of the labyrinth type so that no leakage is likely to occur to the outside. In order to limit the losses by ventilation, the electric motors 3, 4 are left at the aspiration pressure of the compressor 2 and a circulation of gas is organized by a cooling means 37 in order to cool each of the electric motors 3, 4.

In the example illustrated, the cooling means 37 for cooling the electric motors 3, 4 comprises a first cooling circuit 38 comprising ducts 38*a*, 38*b*, 38*c* connected together and leading respectively into the housings 26*a*, 26*b*, 26*c* so as to create a gas circulation. The cooling means 37 may also comprise a second circuit 39 comprising ducts 39*a*, 39*b*, 39*c* leading into the housing 26*a*, respectively opposite the first stage consisting of the impeller 5 and the couplings 24, 25.

It will be noted that the invention is not limited to the embodiment described. In the example illustrated in FIG. 1, the motorcompressor unit 1 is furnished with an in-line, integrated, multi-stage compressor 2 with a single compression section and with four stages.

In the example illustrated in FIG. 2, the motorcompressor 2 comprises two in-line sections 2*a*, 2*b*, for example with two stages each, each carrying out the compression of a gas with, for example, an intermediate cooling. In this case, the housing 26 comprises two intakes E1, E2 and two outlets S1, S2 placed opposite the intake and the outlet of each of these sections. In this embodiment, the first compression stage of one of the sections 2*b* may be placed facing the second compression stage of the other section 2*a*.

In the embodiment of FIG. 3, the first compression stages of each of the sections 2*a*, 2*b* are placed side by side. Such a configuration is known as "back-to-back".

By virtue of the invention that has just been described, the motorcompressor unit can deliver greater power at one and the same rotation speed or a higher rotation speed at one and the same available power without having to overdesign the ends of the driven shaft of the compressor, the transmitted power being distributed over each of the ends.

It will also be noted that the invention makes it possible to retain the dynamic characteristics of the rotors and to completely prevent leakages of gas to the outside atmosphere. It equally makes it possible to eliminate the seals and their auxiliary monitoring systems.

What is claimed is:

1. A centrifugal compressor unit comprising:

a first motor;

at least one compressor comprising a drive shaft supported by two radial bearings secured to a common gas-tight housing, and being driven by a rotor of the first motor, the rotor of the first motor being supported by two end radial bearings secured to the housing; and a set of impellers mounted on the drive shaft, wherein:

an assembly comprising the first motor and the compressor are mounted in the housing, the rotor of the first motor and the drive shaft are connected by a flexible coupling placed in the housing, and the centrifugal compressor unit further comprises a second motor placed in the housing, the second motor comprising a rotor supported by two end radial bearings secured to the housing and connected to the drive shaft by a second flexible coupling, the drive shaft being driven via its two ends by the first and second motors, respectively.

2. A compressor unit according to claim 1, wherein the centrifugal compressor unit comprises a means for cooling the first and second motors.

3. A compressor unit according to claim 2, wherein the cooling means comprises at least one cooling circuit comprising gas circulation ducts connecting the first and second motors and the compressor.

4. A compressor unit according to claim 3, wherein the housing comprises a plurality of housing elements secured together in a sealed manner, each housing element enclosing the first motor, the second motor or the compressor.

5. A compressor unit according to claim 2, wherein the housing comprises a plurality of housing elements secured together in a sealed manner, the plurality of housing units including a first housing element enclosing the first motor or the compressor, and a second housing element enclosing the second motor or the compressor.

6. A compressor unit according to claim 1, wherein the housing comprises a plurality of housing elements secured together in a sealed manner, each housing element enclosing the first motor, the second motor or the compressor.

7. A compressor unit according to claim 6, wherein the housing is provided with orifices made between each of the adjacent housing elements for access to the flexible couplings, each orifice being furnished with sealed obstruction means.

8. A compressor unit according to claim 1, wherein the end bearings are radial magnetic bearings.

9. A compressor unit according to claim 1, wherein the centrifugal compressor unit comprises an axial abutment on which the drive shaft of the compressor rests when the compressor unit is operating.

10. A compressor unit according to claim 9, wherein the axial abutment is a magnetic abutment.

11. A compressor unit according to claim 1, wherein the centrifugal compressor unit comprises an axial thrust-balancing piston on which the drive shaft of the compressor rests when the compressor unit is operating.

12. A compressor unit according to claim 11, wherein the centrifugal compressor unit comprises an axial abutment on which the drive shaft of the compressor rests when the compressor unit is operating.

* * * * *